US005682666A

United States Patent [19]

Lannes

[11] Patent Number: 5,682,666

[45] Date of Patent: Nov. 4, 1997

[54] METHOD OF MAKING A WATER HEATER CAPABLE OF BEING HUNG FROM A SUPPORT

[75] Inventor: Eric M. Lannes, Kentwood, Mich.

[73] Assignee: Bradford White Corporation, Ambler, Pa.

[21] Appl. No.: 585,158

[22] Filed: Jan. 11, 1996

[51] Int. Cl.[6] ..... B23P 11/00; B23C 65/00; F24H 1/50

[52] U.S. Cl. ..... 29/460; 126/363; 126/373; 220/444; 220/476; 264/46.5; 264/46.9; 392/441; 392/449

[58] Field of Search ..... 29/460; 126/344, 126/363, 373; 248/154, 686; D23/318; 4/598; 220/444, 459, 476, 480, 481; 219/385, 429, 432, 438; 392/441, 444, 449; 264/262, 46.5, 46.9

[56] References Cited

U.S. PATENT DOCUMENTS

| | | | |
|---|---|---|---|
| 193,860 | 8/1877 | Frazier | 126/363 X |
| 1,713,685 | 5/1929 | Austin | 126/363 X |
| 3,134,890 | 5/1964 | Teter | 392/441 X |
| 3,151,614 | 10/1964 | Mendelson | 126/363 |
| 4,917,077 | 4/1990 | Scanferia | 126/344 |
| 4,955,573 | 9/1990 | Horvath | 248/154 |
| 4,992,223 | 2/1991 | Nelson . | |
| 5,000,893 | 3/1991 | West et al. . | |
| 5,052,347 | 10/1991 | Nelson . | |
| 5,131,133 | 7/1992 | Peterson et al. | 248/154 X |
| 5,208,964 | 5/1993 | Nelson . | |
| 5,229,048 | 7/1993 | Nelson . | |

FOREIGN PATENT DOCUMENTS

| | | | |
|---|---|---|---|
| 1507/26 | 4/1926 | Australia | 4/598 |
| 102193 | 12/1925 | Austria | 392/449 |
| 106772 | 7/1967 | Denmark | 220/444 |
| 667752 | 10/1929 | France | 126/344 |
| 2012302 | 9/1971 | Germany | 392/449 |
| 2222871 | 3/1990 | United Kingdom | 126/363 |

*Primary Examiner*—S. Thomas Hughes
*Attorney, Agent, or Firm*—Austin R. Miller

[57] ABSTRACT

A method of making a water heater capable of being hung from a support, which includes a water tank, a water inlet, a water outlet, and a jacket positioned around the water tank so as to define a space between the water tank and the jacket. Foamed insulation is positioned in the space between the water tank and the jacket, and the foamed insulation has increasing density and cell uniformity gradients in a direction running from a first portion to a second portion of the jacket. A curved bracket assembly is positioned on the outer surface of the jacket at the second portion of the jacket to coincide with the positioning of foam insulation having highest density and best cell uniformity. A bumper is optionally positioned on the outer surface of the jacket and is vertically aligned with the bracket assembly.

8 Claims, 6 Drawing Sheets

METHOD OF MAKING A WATER HEATER CAPABLE OF BEING HUNG FROM A SUPPORT

FIELD OF THE INVENTION

This invention relates to a method of making a water heater capable of being hung from a support. In particular, this invention relates to a method of making a water heater capable of being hung from a substantially vertical wall.

Conventional water heater construction methods are generally adapted to produce floor-supported water heaters. In making a hangable water heater, however, the method must be adapted to address critical design aspects which are simply not considered in conventional floor-supported water heater construction methods.

One major problem plaguing hangable water heater manufacturing, and particularly the production of foam-insulated hangable water heaters, is insulating the water tank well enough to prevent the hanging assembly from thermally compromising the water heater. This problem is especially acute when, as is often the case, a water heater is hung from a convenient but typically cold support, such as a garage or basement wall, on a hanger assembly constructed from inexpensive but highly heat-conductive materials, such as steel.

The obvious solution of simply adding more insulation to achieve the required thermal efficiency increases the size and bulk of the water heater, and thus conflicts with the purpose for hanging a water heater: the conservation of limited space. Bulkier water heaters are also more costly to ship and more difficult to install.

DESCRIPTION OF THE PRIOR ART

The patent to West et al U.S. Pat. No. 5,000,893, assigned to Bradford White Corporation, discloses a process of forming a high-density foam between a water heater tank and jacket, by applying a so-called two-shot foaming method. A partial shot is introduced into the applicable space and is later followed by a second shot with the top pan immediately secured over the outer jacket upon completion of the second shot. In this way the foam in the second shot will be expanding within a closed container and is therefore subjected to higher pressures as it foams. This, as reported in the reference, causes the foam injected in the second shot to form a denser foam than the free-rising foam injected in the first shot.

Further, Nelson U.S. Pat Nos. 4,992,223 and 5,208,964 disclose methods wherein the insulation foaming process is initiated at the top portion of an inverted water heater. As a result, high-quality foam insulation in terms of cell uniformity, density and insulating ability is produced at what becomes the top portion of the water heater. The Nelson patents teach that the clearance space above the inner water tank is foamed first, thereby assuring that the foam material at this location will have greater uniformity in foam density and cell structure than at the lower portion of the annular space, so as to provide enhanced thermal efficiency at the most critical location, namely, in the space between the top of the water tank and the top pan of the water heater. The water heaters of the Nelson patents are intended for floor-mounting, with the plumbing fittings for inlet water and outlet water located at the top pan. There is no suggestion in the Nelson patents of the concept of positioning high-quality insulating foam between any mounting assembly of a hangable water heater and a water tank to protect against heat loss via conduction through the mounting assembly itself.

The teachings of the aforementioned prior art references show inconsistent findings as to what portion or portions of poured foam have the best consistency or uniformity of foam density and cell structure. The Nelson patents appear to suggest that the best foam is created at the bottom of the pour, while the West patent indicates that, particularly when the top pan is immediately secured in place, the best foam occurs at the top of a pour because of the pressure created by the presence of the top pan. Accordingly, there is confusion, or at least inconsistency, in the prior art as to where and in what manner an optimum foam efficiency may be obtained in a particular case.

OBJECTS OF THE INVENTION

It is an object of the invention to provide a method of making a foam-insulated water heater capable of being wall-hung from a support, and wherein insulating foam is provided with optimum characteristics of foam density and uniformity in the area adjacent the support.

It is another object of the invention to provide a method for making a thermally insulated hangable water heater that remains in a substantially vertical position when hung from a substantially vertical wall.

It is still another object of the invention to provide a method of making a thermally insulated hangable water heater which is capable of being installed in close proximity to an overhead obstruction, such as a ceiling, with generally vertically-oriented bottom-entry tubes for water inlet and water outlet.

It is another object of the invention to provide a method for making a thermally insulated hangable water heater which involves constructing a bracket assembly on a wall or the like which maintains the roundness of a substantially cylindrical enclosure encompassing a water tank and, consequently, the water tank's centered position relative to the enclosure.

It is another object of the invention to provide a method for making a thermally insulated hangable water heater which involves adhering a foam insulation to both the water tank and the enclosure encompassing the water tank, wherein the foam insulation provides a strengthening effect which stabilizes the position of the water tank within the water heater.

It is yet another object of the invention to provide a method of making a thermally insulated hangable water heater wherein a chemically-foamed insulation is located between the water tank and the outer enclosure of a water heater, the insulation possessing increasing density and cell uniformity gradients running from the bottom portion to the top portion of the water heater so that high-quality insulating foam is present between the water tank and a mounting assembly positioned at the top portion of the water heater.

Other objects and advantages of the invention will become apparent to those skilled in the art from the drawings and the following description.

SUMMARY OF THE INVENTION

The invention provides a method of making a water heater capable of being hung from a support, attached to a vertically oriented surface such as a cold wall. The water heater includes a water tank and a substantially cylindrical outer jacket surrounding the water tank. The method involves filling the space between the water tank and the outer jacket with foam insulation having increasing cell uniformity and density gradients extending from the bottom portion to the top portion of the water heater relative to its normal position in use. Thus, foam insulation having the best and most uniform density, uniform cell structure, and high-thermal efficiency is positioned adjacent a bracket provided below the top portion of the water heater. In addition, the foam insulation adheres to both the water tank and outer jacket to provide a strengthening effect which stabilizes the position of the water tank within the water heater.

This arrangement of the foam insulation is achieved in the invention by constructing the hangable water heater upside-down relative to its normal position in use (hereinafter, "top" and "bottom" are used in reference to the water healer's normal position in use). The chemicals which react to form the foam insulation are introduced into the upside-down water heater through the uncovered bottom of the water heater and move downwardly so that the foaming reaction produces the best insulation at the top portion of the water heater. As the foaming reaction proceeds, foam insulation possessing less cell uniformity and less density begins to fill the space surrounding the water tank at the bottom portion of the water heater. Thus, after hardening, the foam insulation possesses increasing cell uniformity and density gradients from the bottom to the top portion of the water heater.

Before introducing the foaming chemicals, a bracket is positioned at the top portion of the water heater to coincide with the eventual position of the foam insulation having the best and most uniform density and cell structure. The bracket assembly comprises an inner bracket portion positioned within the inside surface of the outer jacket and an external wall bracket positioned on the outside surface of the outer jacket. Both the inner bracket portion and the wall-engaging bracket are curved, but the inner bracket may be of less curvature than the outer jacket. The entire bracket assembly is positioned to coincide with the positioning of the best and most dense foam insulation and, unlike other methods, the inner bracket is not mounted on the water tank itself. Thus, the critical area extending between the bracket assembly and the water tank is filled with foam or fiberglass or other insulation having the best insulating qualities. This method results in a structure which minimizes heat loss from the water heater even when the bracket is made of inexpensive metal or any other good conductor of heat.

As mentioned, the bracket assembly is curved but need not necessarily coincide with the curvature of the outer jacket. The inner bracket may be of less curvature than the outer jacket, with the intervening space filled with insulation, thereby preserving the substantially cylindrical shape of the outer jacket. This promotes even circumferential spacing between the outer jacket and the water tank, and allows the use of the same size bracket for a variety of tank diameters.

The invention further involves the preferred step of positioning a bumper on the bottom portion of the outside surface of the water heater and vertically aligned with the bracket assembly. The bumper coacts with the bracket to maintain the water heater in a substantially vertical position when hung from a substantially vertical wall or the like.

DETAILED DESCRIPTION OF THE INVENTION

Figure 1:
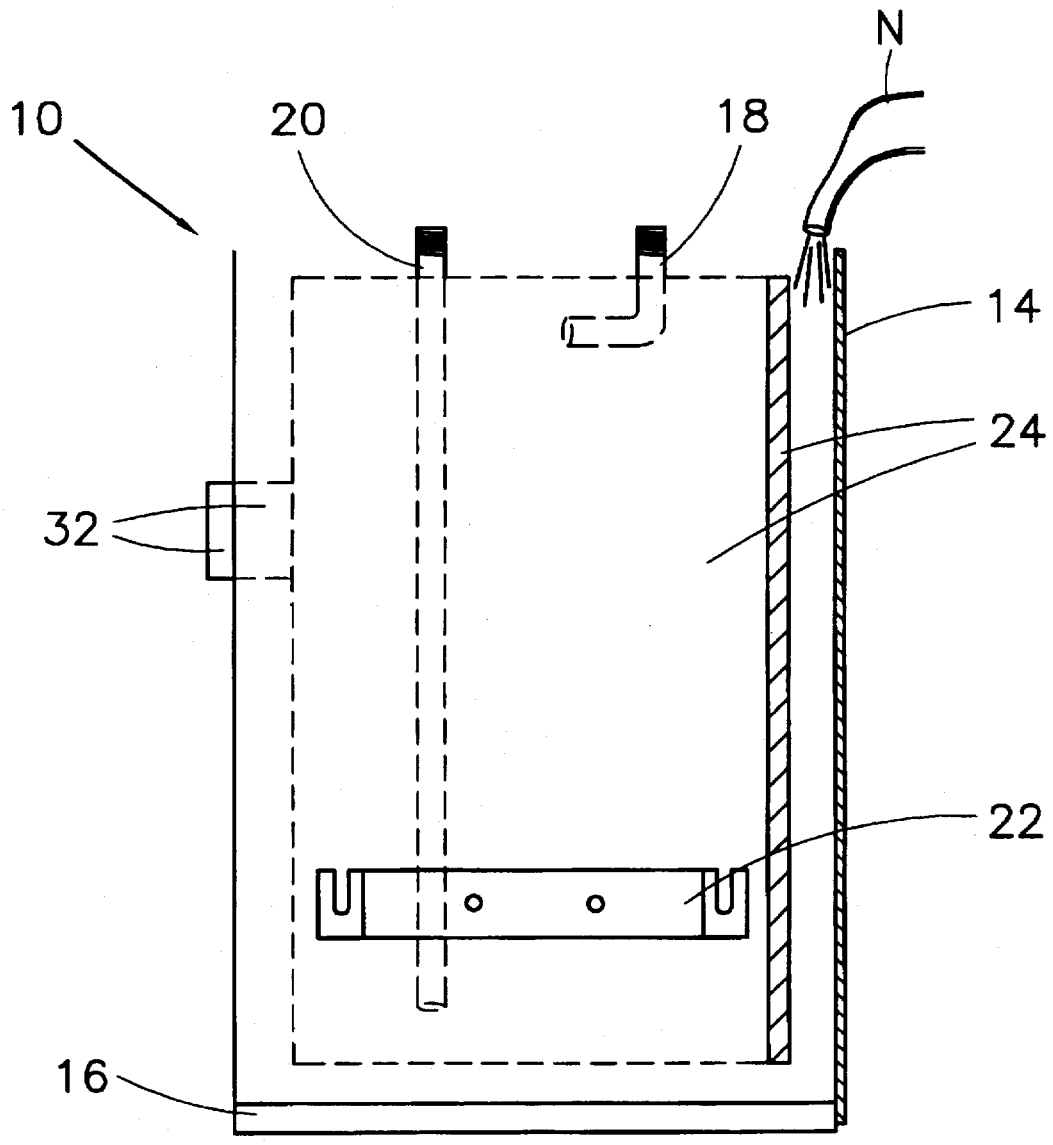
FIG. 1 is a simplified schematic front elevational view of a hangable water heater which shows a method of positioning foam insulation in accordance with the invention, with a portion broken away and taken in section for ease of understanding, and showing the introduction of foaming chemicals through the bottom portion of the upside-down water heater.

Although a particular form of apparatus and method steps have been selected for illustration in the drawings, and although specific terms will be used in this Specification for the sake of clarity in describing the apparatus and method, the scope of this invention is not intended to be limited either by the drawings selected or the terms used in this description, but is defined in the appended claims.

Referring now to FIG. 1, a partially constructed water heater 10, capable of being hung from a substantially vertical wall and upside-down relative to its installed position, is shown. Water heater 10 includes water tank 24, outer jacket 14, top pan 16, wall bracket 22 and heating and control apparatus 32. Cold water inlet 18 and hot water outlet 20 are connected into the tank 24. Foaming chemicals are being introduced into the space between water tank 24 and outer jacket 14 through the uncovered bottom of water heater 10. By introducing the foaming chemicals in this manner, the chemicals progress downward so that a foam insulation having increasing density and cell uniformity gradients from the bottom to the top portion of water heater 10 as installed forms between outer jacket 14 and water tank 24.

Figure 2:
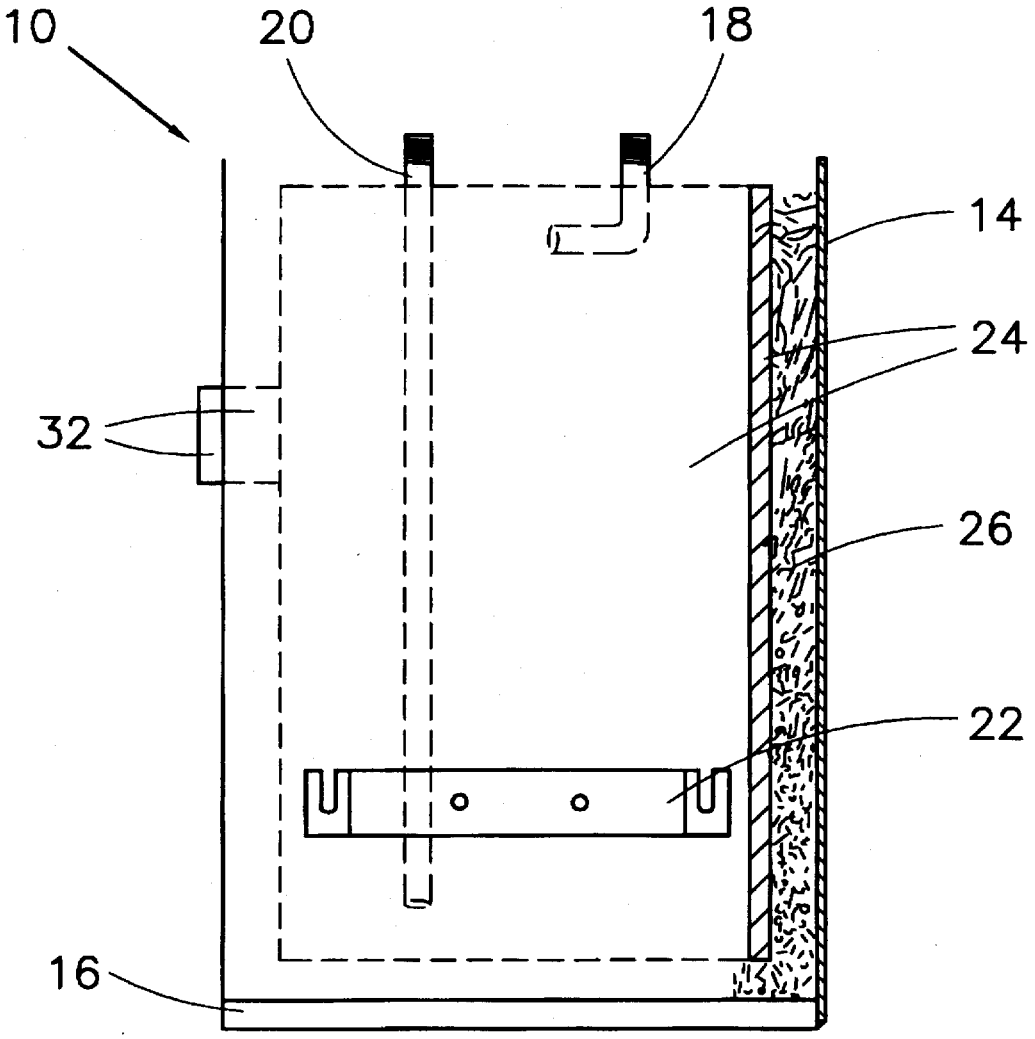
FIG. 2 is a simplified schematic front elevational view of the water heater shown in FIG. 1 after the foam insulation is positioned in accordance with the invention.

FIG. 2 shows foam insulation 26 positioned between outer jacket 14 and water tank 24. An exaggerated density and cell structure of foam insulation 26 is shown to emphasize that a denser, more uniform cell structure is positioned at the top portion of water heater 10, which corresponds with the position of wall bracket 22. Thus, high-quality foam insulation is positioned between water tank 24 and wall bracket 22, thereby minimizing heat loss through bracket 22. Further, foam insulation 26 is adhered to both water tank 24 and outer jacket 14 to provide a strengthening effect which stabilizes the position of water tank 24 in water heater 10.

Figure 3:
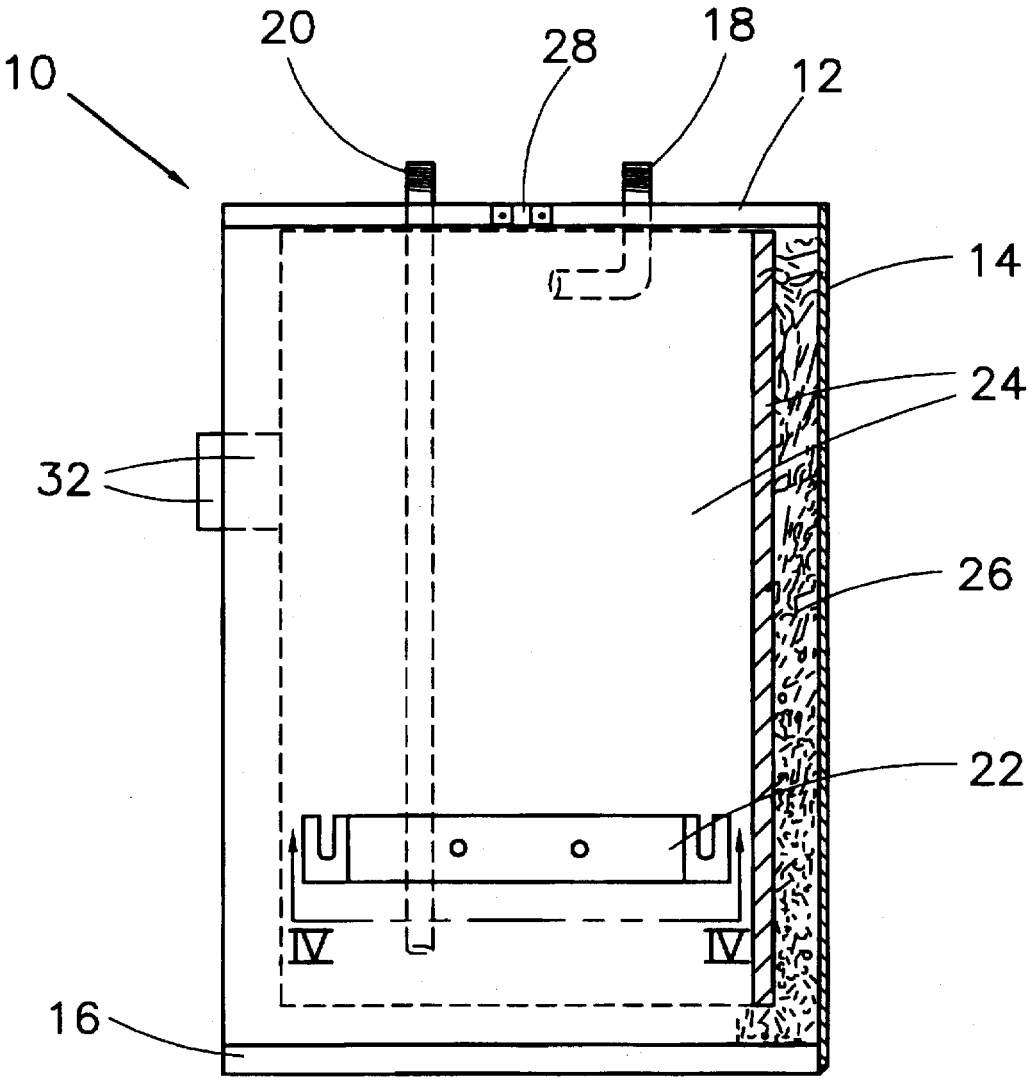
FIG. 3 is a simplified schematic front elevational view of the water heater shown in FIG. 2 after the bottom pan is attached.

FIG. 3 shows the fully constructed water heater of FIGS. 1 and 2. Bottom pan 12 is attached to outer jacket 14 such that cold water inlet 18 and hot water outlet 20 extend through bottom cover 12. Bumper 28 is secured to bottom cover 12 in this embodiment of the invention, and preferably extends substantially the same distance from outer jacket 14 as does wall bracket 22 so as to maintain water heater 10 in a substantially vertical position.

Figure 4:
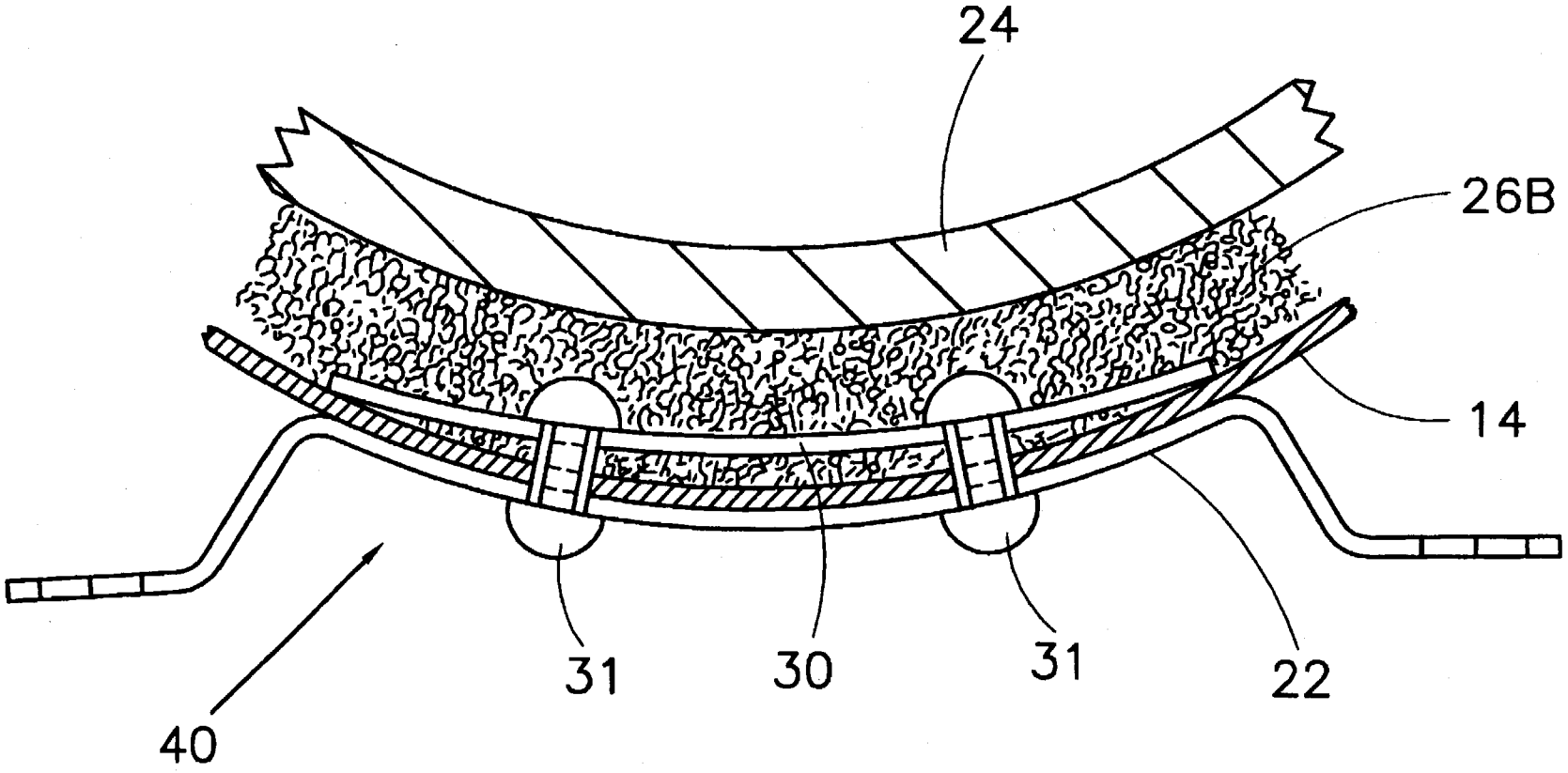
FIG. 4 is a fragmentary sectional top plan view of the water heater bracket assembly of FIGS. 1–3, taken as indicated by lines and arrows IV—IV which appear in FIG. 3.

FIG. 4 shows one form of a wall-mounting assembly. Wall bracket 22 is positioned on the outside surface of outer jacket 14, while inside bracket 30 is aligned with wall bracket 22 on the inside surface of outer jacket 14. Wall bracket 22 is shown to be curved to conform to the curvature of outer jacket 14, while inside bracket 30 is shown to be of less curvature than outer jacket 14. Wall bracket 22 is secured to inside bracket 30 by bolts 31 or other suitable means. Bolts 31, wall bracket 22 and inside bracket 30 are often composed of strong, inexpensive but highly heat-conductive metals to minimize cost. High-quality, small-cell and uniform foam insulation 26B is shown positioned between inside bracket 30 and water tank 24, and between inside bracket 30 and outer jacket 14.

Figure 5:
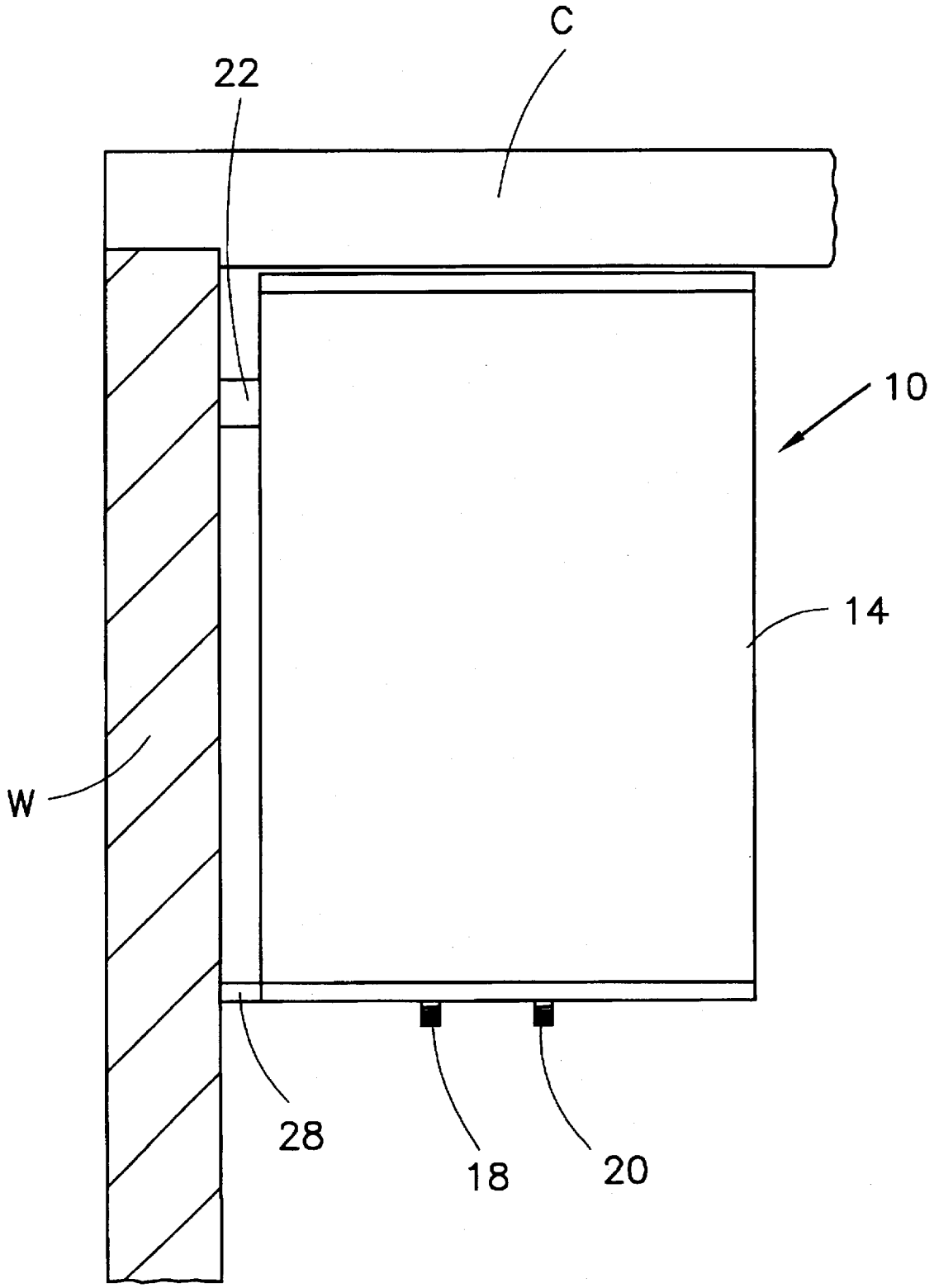
FIG. 5 is a simplified schematic side elevation of the water heater of FIG. 3, hung from a substantially vertical wall W.

FIG. 5 is a schematic depiction of a water heater 10 hung from a substantially vertical wall W. Wall bracket 22 and bumper 28 are vertically aligned and extend from outer jacket 14 so that water heater 10 remains in a substantially vertical position when hung. Water inlet 18 and water outlet 20 are positioned on the bottom portion of water heater 10 so that water heater 10 may be hung adjacent to a ceiling C or other overhead obstruction. Bumper 28 is optional.

Figure 7:
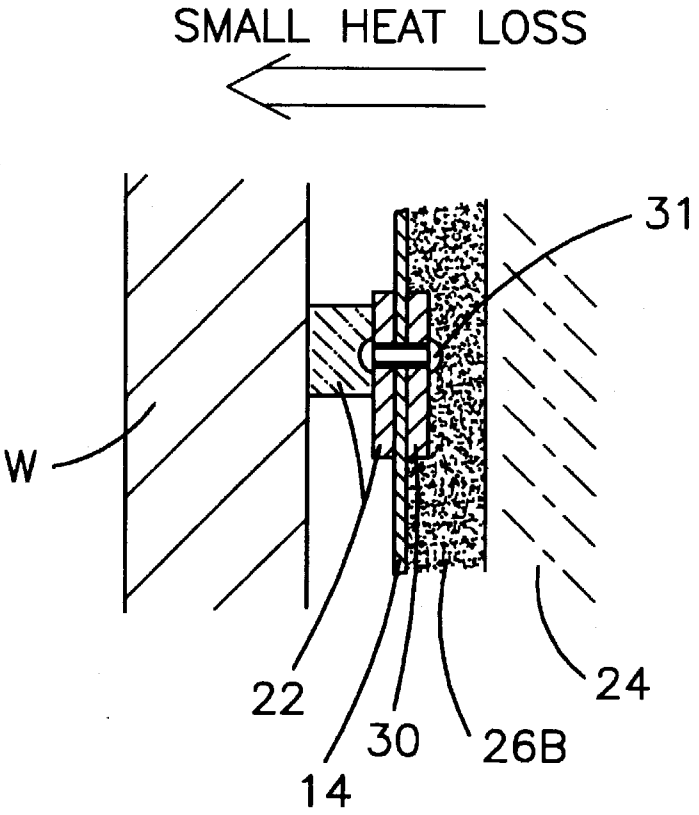
FIG. 7 is a fragmentary sectional view of a hangable water heater manufactured in accordance with this invention, with minimized heat loss through the bracket area in the presence of high density, highly uniform foam insulation.
Figure 6:
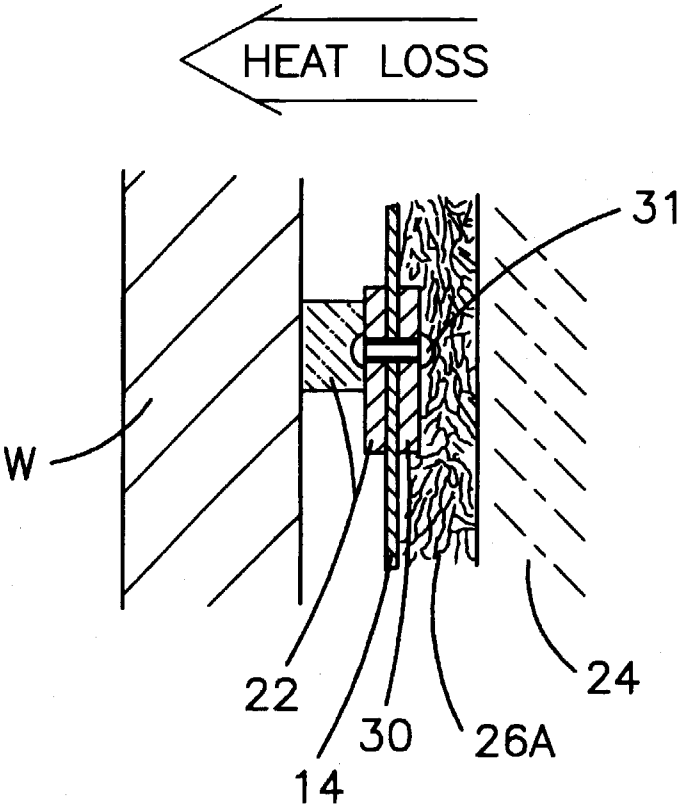
FIG. 6 is a fragmentary sectional view of a hangable water heater, taken in section, showing heat loss when the space between the water tank and the bracket is insulated with low density, non-uniform foam insulation.

FIGS. 6 and 7 show the different heat losses that occur through a bracket assembly when foam insulations having different densities and cell uniformities are used. In both FIGS. 6 and 7, the bracket assembly of an installed hangable water heater is shown. The water heater is hung from a substantially vertical wall W by a bracket assembly consisting of wall bracket 22 and inside bracket 30. In FIG. 6, foam insulation 26A, having low density and a non-uniform cell structure of the kind located at the top of an open-top vertical pour, is positioned between outer jacket 14 and water tank 24. In FIG. 7, the foam insulation 26B possesses high density and uniform cell structure and is positioned between outer jacket 14 and water tank 24 in the vicinity of the bracket members 22, 30 and the interconnecting bolts 31. The very different heat losses in the structures depicted in FIGS. 6 and 7 are shown schematically above the drawings, and indicate that an advantageously smaller heat loss through the bracket assembly is suffered when high-quality small-pore and uniform foam insulation 26B is used as compared with relatively low-density, non-uniform foam insulation 26A at that location. Bolts 31 are significant avenues of heat loss since they extend from within outer jacket 14 to the bracket 22 which in turn is connected in a heat exchanging relationship to wall W. As noted, wall W is often cold enough to be a substantial heat sink.

The hangable water heater construction method of the invention provides many advantages over conventional water heater construction methods. Providing dense and highly uniform foam insulation between the water tank and bracket assembly prevents the bracket from thermally compromising the water heater unit. Such an arrangement of foam insulation eliminates the need for adding insulation to achieve required efficiency ratings even when the water heater is hung from a cold wall on a bracket assembly constructed from highly heat-conductive metals.

Adhering foam insulation to both the water tank and outer jacket provides a strengthening effect which stabilizes the position of the water tank within the water heater. This stabilization effect is particularly important considering the substantial weight of a fully-charged water heater.

The hanger assembly includes an inner bracket and an outer bracket, both curved, but the inner bracket need not substantially conform to the shape of the outer jacket. When the curvatures conform, the hanger assembly preserves the substantially cylindrical shape of at least a portion of the outer jacket to promote even circumferential spacing between the outer jacket and the water tank, thereby facilitating uniform foam insulation distribution around the water tank. However, the inner and outer brackets may be made can be used for water heaters of various outside diameters. If the flatness of the inner bracket creates space between the inner bracket and outer jacket, that space becomes filled with foam, which reinforces the jacket shape and serves as a cushioning means.

Further, the hanger assembly is installed prior to the insulation foaming process, thereby preventing the leaking of foam insulation through holes in the outer jacket pre-cut for the hanger assembly. To facilitate the water heater manufacturing process, holes in the outer jacket are typically pre-cut for the hanger assembly.

Positioning the cold water inlet and hot water outlet at the bottom of the water heater allows the water heater to be hung close to a ceiling or other overhead obstruction, thereby providing even greater positioning freedom. It also allows the water inlet and outlet pipes to be vertically oriented without installation problems.

The bumper 28, vertically aligned with the bracket assembly and preferably extending substantially the same distance from the outer jacket as does the bracket assembly, coacts with the bracket to ensure that a water heater mounted on a substantially vertical wall is oriented in a substantially vertical position. The bumper 28 greatly facilitates installation because piping hook-ups remain vertically aligned with pipe connections entering at the bottom of the tank. It may, however, be replaced by a separate bumper or protrusion on an adjacent wall.

Although this invention has been described in connection with specific forms thereof, it will be appreciated that a wide variety of equivalents may be substituted for the specific elements described therein without departing from the spirit and scope of this invention as defined in the appended claims. For example, the bracket assembly may be positioned anywhere on the water heater so long as foam, fiber or other insulation having preferential density and cell uniformity is positioned between the bracket and the water tank. Moreover, the bracket may be conformed to hang the water heater from a support other than a substantially vertical wall, such as a ceiling, a beam, or even an object of irregular shape. Instead of being positioned on the water heater, a bumper may be attached to the support from which the water heater is hung to maintain the water heater in a substantially vertical position. Many other variations may be practiced, all within the spirit and scope of the invention as defined in the appended claims.

What is claimed is:

1. In a method of producing a water heater capable of being hung from a support, said water heater including a water tank, a water inlet positioned on said water tank, a water outlet positioned on said water tank, and a substantially cylindrical enclosure positioned around said water tank so as to define a space between said water tank and said enclosure; said enclosure having an outer surface, an inner surface, a first portion and a second portion, said first portion being adjacent to said second portion; the steps which comprise:

(a) securing a bracket assembly to said outer surface and said inner surface of said enclosure at said second portion of said enclosure; and (b) thereafter positioning an insulation in said space between said water tank and said enclosure such that said insulation possesses increasing gradients of density and uniformity in a direction running from said first portion to said second portion of said enclosure.

2. In a method of producing a water heater capable of being hung from a support, said water heater including a water tank, a water inlet positioned on said water tank, a water outlet positioned on said water tank, and a substantially cylindrical jacket positioned around said water tank so as to define a space between said water tank and said jacket; said jacket having an outer surface and an inner surface, said jacket and said space each having a top portion and a bottom portion, said top and bottom portions corresponding in position to each other and to a top portion and a bottom portion of said water heater when hung from said support; the steps which comprise:

(a) securing a bracket assembly to said outer surface and said inner surface of said jacket at said top portion of said jacket; and (b) thereafter foaming and solidifying a foam insulation in said space between said water tank and said jacket beginning at said top portion and proceeding to said bottom portion of said space, whereby said foam insulation possesses increasing gradients of density and cell uniformity in a direction running from said bottom portion to said top portion of said jacket.

3. The method according to claim 2, wherein said jacket is connected to a top pan and a bottom pan.

4. The method according to claim 2, further comprising positioning a bumper on said outer surface of said jacket so that said bumper is substantially vertically aligned with and below said bracket assembly.

5. The method according to claim 4, wherein said support is a substantially vertical wall, and wherein said bracket assembly and said bumper extend substantially the same distance from said jacket so as to maintain said water heater in a substantially vertical position when hung from said substantially vertical wall.

6. The method according to claim 2, wherein said water tank has a top portion and a bottom portion relative to the position of said water heater when hung from a support, and wherein said water outlet and said water inlet are positioned adjacent said bottom portion of said water tank.

7. The method according to claim 2, wherein said bracket assembly comprises an inner bracket positioned on said inner surface and said top portion of said jacket, and an outer bracket positioned on said outer surface of said jacket adjacent said inner bracket, said inner bracket being attached to said outer bracket.

8. The method according to claim 2, further comprising adhering said foam insulation to both said water tank and said jacket during said foaming and solidifying to stabilize the position of said water tank within said water heater.

* * * * *